US007863997B1

(12) United States Patent
Alton et al.

(10) Patent No.: US 7,863,997 B1
(45) Date of Patent: Jan. 4, 2011

(54) COMPACT TUNER FOR HIGH POWER MICROWAVE SOURCE

(75) Inventors: William J. Alton, Pepperell, MA (US); David R. Lawson, Portland, ME (US); George M. Harris, Auburn, ME (US); Isaac Feldpausch, Nashua, NH (US); E. Eugene Eves, II, Westford, MA (US); Paul M. C. Alton, Mason, NH (US)

(73) Assignee: The Ferrite Company, Inc., Nashua, NH (US)

( * ) Notice: Subject to any disclaimer, the term of this patent is extended or adjusted under 35 U.S.C. 154(b) by 382 days.

(21) Appl. No.: 12/157,917

(22) Filed: Jun. 13, 2008

Related U.S. Application Data

(60) Provisional application No. 60/945,615, filed on Jun. 22, 2007.

(51) Int. Cl.
*H01P 5/00* (2006.01)
*H01P 1/00* (2006.01)

(52) U.S. Cl. ..... 333/24 R; 333/113; 333/248

(58) Field of Classification Search ..... 333/113, 333/24 R, 248
See application file for complete search history.

(56) References Cited

U.S. PATENT DOCUMENTS 4,051,447 A * 9/1977 Heckman, Jr. ..... 333/24 R
4,671,952 A * 6/1987 Masse ..... 423/539
4,801,903 A * 1/1989 Mohr ..... 333/113
6,034,361 A * 3/2000 Hudak ..... 219/702
7,042,305 B2 * 5/2006 Wray ..... 333/22 R
7,112,970 B2 * 9/2006 Kreager et al. ..... 324/601

OTHER PUBLICATIONS

Helszajn, J., Riblet, Gorden P. and Mather, J. R., "Insertion Loss of 3-Port Circulator with One Port Terminated in Variable Short Circuit";, *IEEE Transactions on Microwave Theory and Techniques*, Nov. 1975, pp. 926-927.

Lombardini, P. P., Schwartz, R. F. and Kelly P. J., "Criteria for the Design of Loop-Type Directional Couplers for the L Band"; *IRE Transactions on Microwave Theory and Techniques*, Oct. 1956, pp. 234-239.

Roybal, W. T., Bradley, J. III, Rees, D., Torrez, P. A., Warner, D. K. and DeBaca, J., "High-Power Circulator Test Results at 350 and 700 MHz"; LINAC 2000 Conference Paper # THE06, eConf C000821 THE06, Aug. 16, 2000, [online]www.arXiv:physics/0008089v1 [physics.acc-ph].

* cited by examiner

*Primary Examiner*—Dean O Takaoka
(74) *Attorney, Agent, or Firm*—Hamilton, Brook, Smith & Reynolds, P.C.

(57) ABSTRACT

A compact, high speed, miniaturized adaptive controller for a microwave power generator. A pair of directional couplers are arranged between a microwave source and a circulator to measure forward and reverse power. An electromagnet in the circulator may be controlled in response to a VSWR calculation. In some arrangements, the directional couplers may be loop-type directional couplers that are integrated into a waveguide magnetron launching assembly. The directional couplers may use a tapered coaxial line that presents an impedance that reduces along the length thereof. This enhances the directivity of the loop coupler and improves performance of the controller.

2 Claims, 7 Drawing Sheets

(ASSUMING LINEAR DETUNING)
POWER FORWARD MAXIMUM = M
CURRENT FOR MAX FORWARD POWER, ZERO REFLECTED POWER = 0 PREFERRED CIRCULAR SETTING
CURRENT AT ZERO (mW) POWER = -A

| | | | | | | |
|---|---|---|---|---|---|---|
| $P_F$ | 0 | .25M | .5M | .75M | M | |
| $P_R$ | 0 | 0 | 0 | 0 | 0 | |
| I | -A | -.75A | -.5A | -.25A | 0 | |
| $P_F$ | 0 | .25M | .5M | .75M | M | |
| $P_R$ | 0 | .25M | .5M | .75M | M | |
| I | -A | -.75A | -.5A | -.25A | -0 | MINIMUM HEATING |
| | | -.25A | +.5A | +1.25 | +2A | MINIMUM HEATING |
| $P_F$ | 0 | .25M | .5M | 75M | M | |
| $P_R$ | 0 | .13M | .25M | .38M | .5M | |
| I | -A | -.75A | -.5A | -.25A | 0 | MINIMUM HEATING |
| | | -.5A | 0 | +.5A | +A | MINIMUM HEATING |

$P_F$ = FORWARD POWER INTO CIRCULATOR
$P_R$ = POWER REFLECTED BACK INTO PORT-2
I = COIL BIAS CURRENT

CURRENT BIAS AS A FUNCTION OF FORWARD AND REFLECTED POWER INTO THE CIRCULATOR, FOR OPTIMIZED VSWR.

FIG. 5

COMPACT TUNER FOR HIGH POWER MICROWAVE SOURCE

RELATED APPLICATION(S)

This application claims the benefit of U.S. Provisional Application No. 60/945,615, entitled "VSWR Adaptive Tuner", filed on Jun. 22, 2007. The entire teachings of the above application(s) are incorporated herein by reference.

BACKGROUND OF THE INVENTION

Many radio frequency (RF) power generators include a controller to regulate the RF output power and prevent damage due to load mismatch, excessive supply voltage, or excessive operating temperature. Such controllers typically include some type of detector, to determine a level of generated power, and a controller, to control the operation of the power generator in response to detected output power or other operating conditions.

At microwave frequencies, it has been a common design approach for quite a number of decades to dispose a circulator between a source of RF power, such as a magnetron vacuum tube, and a system to which the RF power is to be applied. The circulator serves to ensure there is a minimum amount of power reflected back to the magnetron. This provides a more stable operation mode for the magnetron and also has the benefit of enhancing tube life.

At microwave radio frequencies, a so-called ferrite junction type circulator is commonly used. A ferrite junction circulator is formed of a ferrite material within an area joined to three symmetrically placed transmission lines. A permanent magnet produces magnetic flux through the junction. A supplemental electromagnet may be used to control the overall magnetic field applied to the junction. For example, a current applied to the electromagnet can be increased or decreased, in response to measured ambient conditions, to effect overall control of the magnetic field applied to the junction.

Correct operation of a ferrite junction circulator depends on a number of factors, including the inherent characteristics of the ferrite material chosen, the dimensions of the ferrite, and the overall strength of the magnetic field. A problem also exists with maintaining optimum performance of a ferrite junction circulator over a range of temperatures. This is due to a number of factors—one factor being that the intrinsic magnetization of the ferrite material changes with temperature. Thus, determination of an optimized value of magnetization typically requires a different value for the applied magnetic field as temperature changes.

Where both the ferrite material in the junction, and the magnet supplying the applied magnetic field to the junction, are subjected to the same varying temperature, it is possible to cause the magnetic field to vary in a way which compensates for the changes in the ferrite intrinsic magnetization. This is usually done by using a special steel, with rapid changes of its saturation magnetization with temperature, as part of the magnetic circuit.

In applications where the junction is subjected to very large microwave power levels, the ferrite material is subjected to substantial heating. Thus, the problem becomes more complicated. The area of the junction to which the ferrite is attached is normally water cooled to provide for such high power operation. Thus, the ferrite material will be held at a very different temperature than the external magnet(s). Passive magnetic compensation for the changes in the temperature of the ferrite material alone will not therefore produce acceptable results in this application.

One technique for accommodating temperature variation in a water-cooled ferrite circulator has been described by AFT Microwave GmbH of Backnang—Waldrems, Germany. That approach is based on sensing the increase in temperature of the cooling water applied through the circulator. The temperature of this cooling water naturally depends on the amount of power being passed through the junction, and is indicative of the increase in the ferrite temperature. The required adjustment to the magnetic circuit field is then achieved by using control circuitry, driven by measured temperature differentials in the cooling system. This in turn provides an adjustment current to the electromagnet coil, to modify the overall strength of the magnetic field applied to the junction.

This approach of measuring the cooling water temperature has its deficiencies, however. There is a time delay between the heating of the ferrite material and any ultimate final change in its intrinsic magnetization. This results in a delay in the heat being conducted to the cooling water, which of course, drives the input to the control circuit. See Roybal, W. T. "High Powered Test Results at 350 and 700 MHz", Proceedings of the XX International Linac Conference, Monterey, Calif., pp. 980-982.

In addition, the degree of correction to optimize performance is based on empirically derived data which has been used to set up the control circuit parameters. This cannot be practically done at the customer location on every device delivered. Therefore, normal tolerances on materials and electronics will prevent complete optimization of all units.

For a high power application where the power from the tube may be suddenly increased, the ferrite response time will typically be very short. As the system microwave energy penetrates the ferrite material, junction operation therefore changes rapidly. However, even a rapid change will show immediately in the amount of measured reflected power. Thus, another approach which has been used in the past is to measure an input Voltage Standing Wave Ratio (VSWR) as presented to the magnetron tube. This approach can be used when additional circuit components, such as directional couplers, are available to estimate a forward power $P_f$ and a reverse power $P_r$. The VSWR can then be estimated by the following calculation:

$$VSWR = \frac{\left(1 + \sqrt{P_r / P_f}\right)}{\left(1 - \sqrt{P_r / P_f}\right)}$$

It is therefore possible to provide a logic system that measures and calculates the VSWR and then controls an electromagnet to adjust the overall magnetic field applied to the circulator. The logic can be arranged to continually minimize the VSWR.

It has also been known, therefore, to provide a detector for measuring forward and reverse power levels at the circulator. These power levels are then digitized and fed to a computing device such as a computer located at a customer site. The computer can be programmed to receive the input measured forward and reverse powers values and determine whether the VSWR is increasing or decreasing. The computer can then also be connected to output incremental changes to a power supply that drives a coil of the electromagnetic circuit, with the computer continuing to make adjustments to the coil current until the measured VSWR is minimized.

SUMMARY OF THE INVENTION

In preferred embodiments, the present invention is implemented as a VSWR-based adaptive controller used with a microwave system. The environment in which the invention may be used typically includes a microwave source, a circulator, and a microwave system. The circulator is a three port ferrite junction circulator that includes a magnet and an electromagnet. The electromagnet can be used to control the overall resulting magnetic field applied to the junction.

The present invention is more specifically directed to a compact, high speed miniaturized digital control circuit and associated directional couplers. The directional couplers receive signals from the ferrite junction circulator. The directional couplers measure a forward and reverse power level at a circulator input port, digitizes these values, and computes a Voltage Standing Wave Ratio (VSWR). This value is then used to control a drive current applied to the electromagnet.

The compact size of the resulting control unit permits effective application in many existing microwave generator assemblies as well as in new designs.

In some arrangements, the directional couplers may be loop-type directional couplers that are integrated into a waveguide magnetron launching assembly.

In still other arrangements, the directional couplers may be loop-type directional couplers in which terminating resistors are provided by a tapered coaxial line. The coaxial impedance presented by the terminating resistances reduces along the length thereof, so that the line impedance more closely corresponds to any resistance presented from that point to an end short circuit. This improves directivity of the couplers.

Application of the principles of the present invention can greatly enhance magnetron life, ensuring that it always sees a low value of VSWR, irrespective of the output power level or any load that is present at the circulator output.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

FIG. 5 is a table illustrating a range of current required for different forward and reverse powers at the circulator input. This enables the current to be set to a value in a desired operating range without an initial random search.

DETAILED DESCRIPTION OF THE INVENTION

A description of example embodiments of the invention follows. The teachings of all patents, published applications and references cited herein are incorporated by reference in their entirety.

Figure 1:
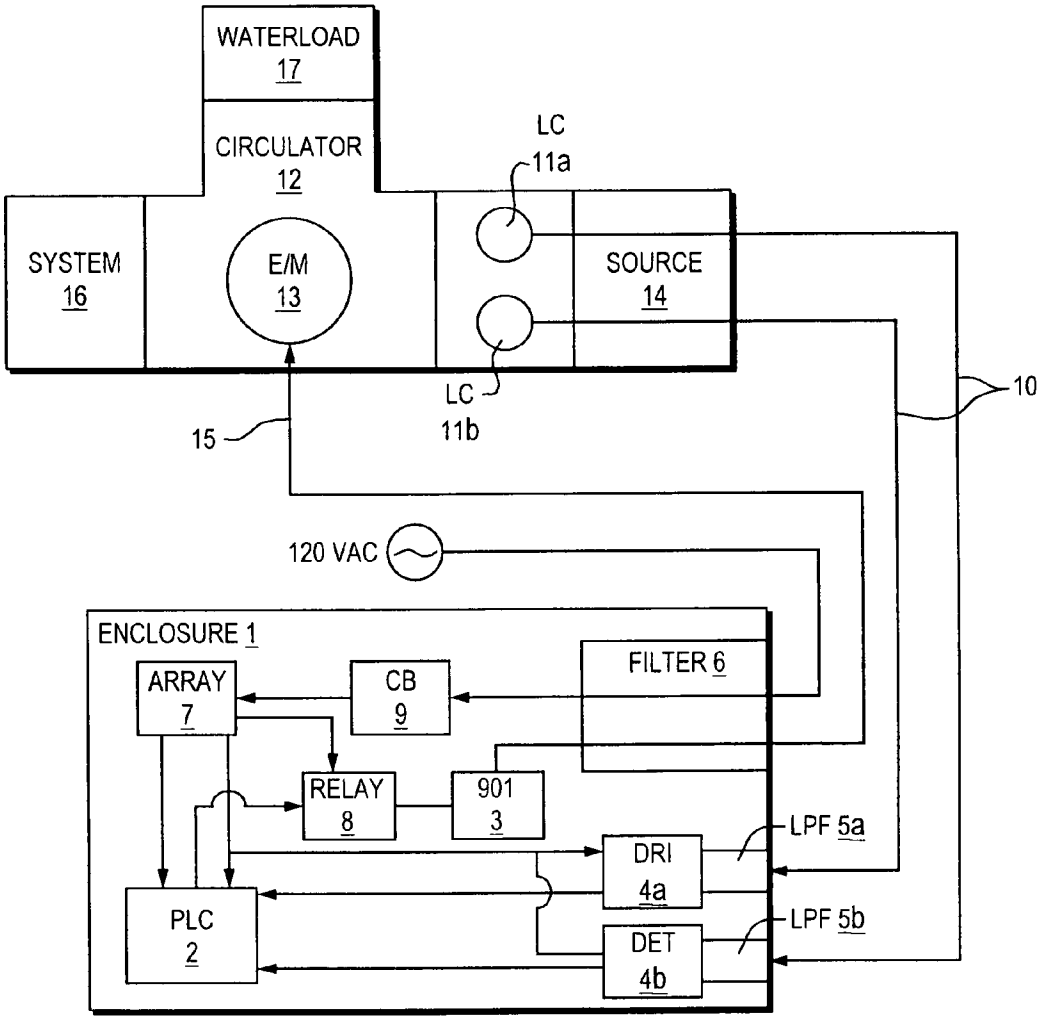
FIG. 1 is a high level schematic diagram of one arrangement for controlling a high power microwave source.

As shown more particularly in FIG. 1, a microwave source 14 generates a microwave frequency that is to be ultimately used by a microwave system 16. The system 16 may be a high power microwave oven, radar, antenna, medical equipment, particle physics research equipment, or the like.

The source 14 may be a magnetron tube. The signal from the source 14 passes to through a circulator 12 before being fed into system 16.

The circulator 12 is preferably a three port, ferrite junction circulator that contains a permanent magnet (not shown) and an electromagnet 13. The permanent magnet provides a main magnetic field. A wire coil can function as the electromagnet 13, and receive a current which also produces a magnetic field at the junction. The coil is physically arranged to add or subtract to the inherent magnetic field produced by the permanent magnet.

A water load 17 is typically provided on a load port (port 2) of the circulator.

The output port (port 3) of the circulator 12 is coupled to the system 16.

Directional couplers 11*a*, 11*b* are disposed at the input port (port 1) of the circulator 12. A first directional coupler 11*a* measures the power being transmitted from the microwave source 14 to the circulator 12 (that is, the forward power, $P_f$). A second directional coupler 11*b* measures the power being transmitted from the circulator 12 to the source 14 (that is, the reverse power, $P_r$). In other embodiments, a third directional coupler (not shown in FIG. 1) may be introduced between the system 16 and the circulator 12 (at port 3).

A controller enclosure 1 may physically enclose a programmable logic controller (PLC) 2, a voltage generator (which may be an off the shelf motor controller) 3, power detectors 4*a*, 4*b*, low pass filters 5*a*, 5*b*, a bypass filter 6, a control relay 8, a power supply 7, a circuit breaker 9, and an alternating current (AC) power source (120 VAC).

The circuits in the control enclosure 1 may operate from a 24 volt direct current (DC) power supply 7 as derived from the 120 volt alternating current (AC) supply. The supply is coupled to a power filter 6 to shunt any RF energy in the conductors to ground. A circuit breaker or a fuse 9 can protect downstream components. Other voltage or supply circuits (not shown) may be used to drive other circuits.

The directional couplers 11*a*, 11*b* are connected to the circuitry within the controller enclosure 1 via coaxial cables 10. The coaxial cables 10*a*, 10*b* may specifically connect signals from the directional couplers 11*a*, 11*b* via respective low pass filters 5*a*, 5*b* and to respective power detectors 4*a*, 4*b*. The power detectors 4, for example, may change the signals measured from an analog current in a milli-ampere range to a voltage.

The PLC 2 reads the detected signals indicative of forward and reverse power, performs a VSWR calculation, and produces a controller output signal. The controller output is then fed via a two wire cable 15 to control the electromagnet 13.

More specifically, the PLC 2 receives signals indicative of forward and reverse power from the power detectors 4*a*, 4*b* and calculates a VSWR estimate. Using this VSWR estimate, the PLC then determines an adjustment amount to be applied as a current to the electromagnetic coil 13. The exact manner of determining this adjustment amount depends on the specific arrangement, size, frequency, power levels, and other technical specifications of the source 14, circulator 12 and system 16.

It is sufficient to say here that the PLC 2 attempts to minimize the VSWR. For example, if the measurements indicate that VSWR is increasing or decreasing, a corresponding adjustment is made to the current applied to the electromagnet 13.

The corrective coil current can be limited by the amount of power reflected back into the circulator 12 in some instances. However, if the reflected (reverse) power can be accurately measured, then, with this knowledge and with knowing the forward power level, the current applied to the electromagnet 13 may be changed to be within an applicable range. In practice, for most applications the circulator 12 junction operates at a rate that is approximately in the Ultra High Frequency (UHF) range of from about 600 to 800 MHz. These devices can also be extremely large physically for typical end uses, for example, the circulator 12 may be several feet across. In these circumstances we have found that the use of only two couplers 11*a*, 11*b* at the circulator input port 1 can provide a sufficiently rapid measurement of VSWR because of the relatively slow thermal time constant of the circulator 12 to changes in applied power.

The adjustment amount is represented by a voltage output by the PLC 2, which may be in a range of from 0 to 24 volts for example. The voltage converter 3 translates the PLC output signal to a signal in a range suitable for controlling the electromagnet 13. For example, this may need to be in a range of from 0 to 90 volts.

The PLC can also control the relay 8 to change the polarity of the output signal. For example, the voltage converter may only be capable of putting out a 0 to 90 volt DC signal. Under control of the PLC 2, the control relay may switches the polarity of this signal to be between −90 and 0 volts DC.

The output voltage may be passed through a bypass filter 6 and then through a two wire cable 15 to be applied across the resistance presented by the electromagnet 13.

In preferred embodiments, the directional couplers 11*a*, 11*b* are stripline type directional couplers in which the terminating resistors are provided by a tapered coaxial structure. The coaxial impedance presented by the terminating resistance thus reduces along their length, so that line impedance more closely corresponds to the resistance from that point to the end short circuit. Thus, for a 50 ohm nominal terminating resistor, the line impedance may initially be 50 ohms, may present a 25 ohm impedance at the resistor half length, and may present a short current at the resistor end. This reduces mismatch at the resistor and enhances directivity of the coupler.

To understand the significance of the characteristics of the directional couplers 11, consider what happens when the power from the magnetron tube source 16 is suddenly increased. The ferrite response time is very short, since the microwave energy penetrates the ferrite. The junction operation therefore changes (degrades) rapidly, and this is shown immediately in the amount of reflected power (VSWR).

Packaging as a Compact VSWR Adaptive Controller

As mentioned in the Background section above, it has been previously known to provide a logic system connected to determine a VSWR, and adjust the current fed to a coil arranged to adjust the circulator magnetic field, to continually minimize the input VSWR of the circulator.

However, in that prior art approach, it has been the case that small electronic logic circuits of sufficient complexity were not available, nor were compact current sources or waveguide compact loop directional couplers with directivity over 32 dB available. The technique used was to write a software program which was loaded into a customer's stand-alone computer. The forward and reverse powers between the tube and circulator were measured by couplers, detectors, and an analog to digital (A/D) converter circuit. These values were then input to the customers main computer system where a computation was carried out of whether the VSWR was increasing or decreasing. The program was then output incremental changes to a power supply driving a coil in the magnetic circuit, and adjustments were made until the VSWR was minimized. The VSWR had an uncertainty factor of 1.05 due to the limited directivity of the couplers used in known prior art.

As can now be understood, in one aspect, the present invention as shown in FIG. 1 can be implemented as a compact, high speed miniature digital control unit that can be completely placed within an enclosure 1. The control unit receives the signals from the directional couplers, digitizes them, computes a VSWR and sends current drive to the circulator to optimize its performance.

The system consisting of the control unit, couplers, and coil for magnetic adjustment of a circulator functions as a VSWR Adaptive Controller. The compact size permits effective application of the unit in many existing microwave assemblies as well in new designs, something that was not possible with a stand alone computer approach.

The end result is a compact control unit that can greatly enhance magnetron 14 life by ensuring that it always sees a low value of VSWR at the circulator 12, irrespective of the magnetron power output or the load that is present.

Directional Couplers with Tapered Impedance to Optimize Directivity

An implementation that effectively minimizes the power reflected by the circulator 12 critically depends on the directivity achieved by the directional couplers 11 being substantially better than the VSWR expressed in dB as a Return Loss. Thus it can be shown that to meaningfully optimize input VSWR to be less than 1.10:1 (corresponding to a 26.5 dB Return Loss) a directivity of greater than 35 dB is required to give a VSWR uncertainty of less than 1.035:1.

Waveguide loop couplers were described in a classic paper by P. P. Lombardini; R. F. Schwartz and P. J. Kelly, entitled "Criteria for the Design of Loop-Type Directional Couplers for the L Band," in *Proceedings of the IRE*, Vol. MTT-4, No. 4 pp 234-239, October 1956. Those couplers used a loop terminating resistor plus a tuning sleeve used with the resistor.

Figure 2:
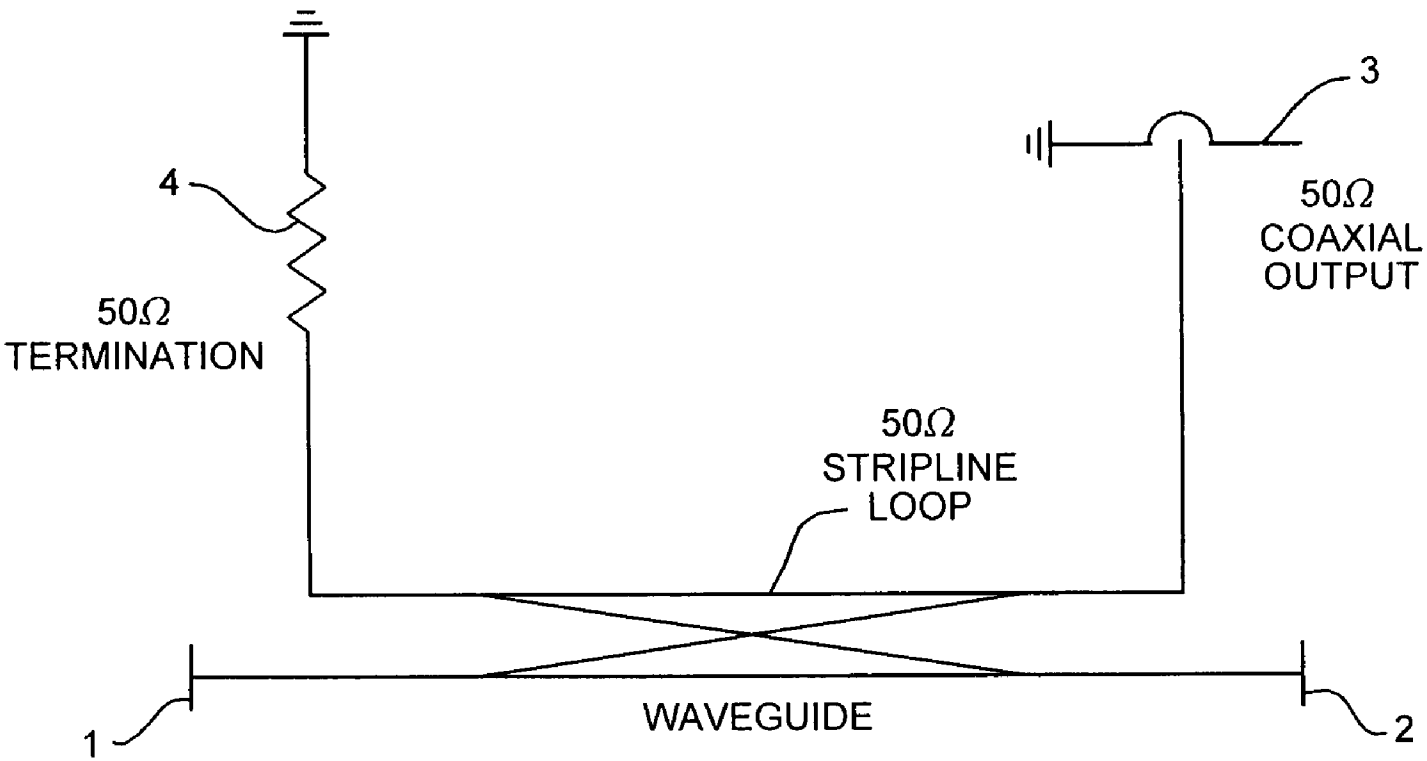
FIG. 2 is a schematic of a directional loop coupler.
Figure 3:
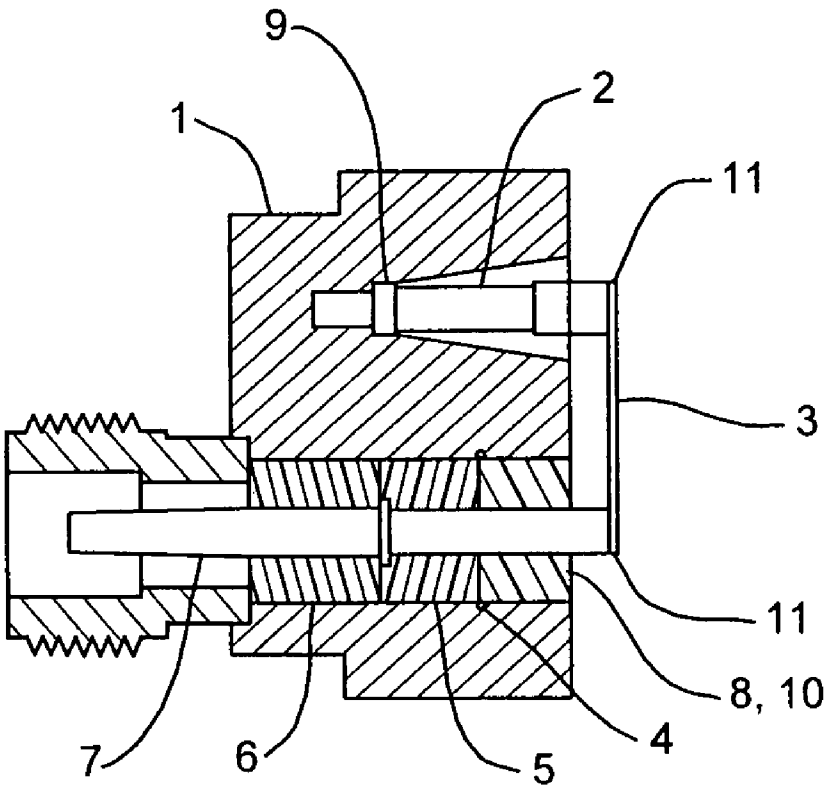
FIG. 3 is a mechanical assembly drawing of the directional loop coupler.

A generalized schematic of one such coupler is shown in FIG. 2. In a preferred embodiment, however, the loop directional couplers are integrated into waveguide magnetron launcher assemblies as part of the VSWR Adaptive Controller. FIG. 3 is a front and cross-sectional view of one embodiment of a specific coupler 11 used in a preferred embodiment.

Figure 4:
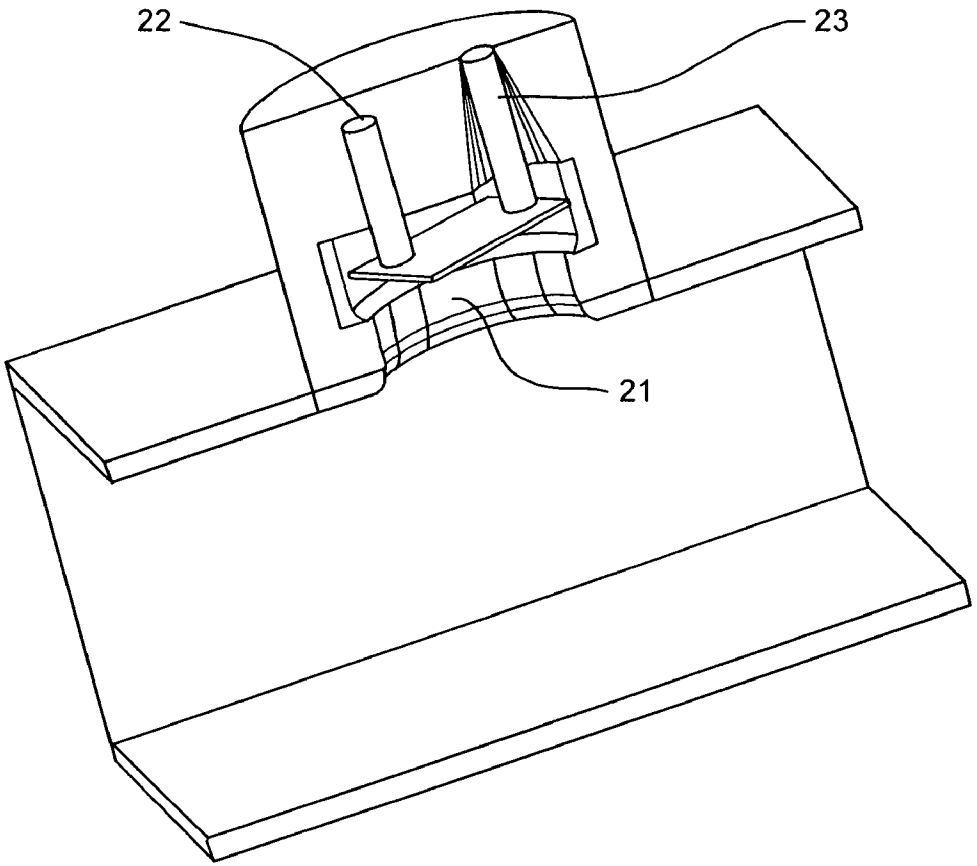
FIG. 4 is a more detailed view of a directional loop coupler having a tapered termination resistor.

FIG. 4 is a cut away view of the same embodiment of the coupler with its associated rectangular waveguide 20, showing a coupling hole 21 adjacent the input (Port 1) the waveguide (Port 2), the coupled coaxial output port 22 (Port 3), and tapered termination 23 (Port 4).

A wave traveling from Port 1 to Port 2 of the waveguide will couple to Port 3, and a wave from Port 2 to Port 1 will couple to Port 4. The directivity of this coupler is a measure of the deviation of the coupler from ideal in that with Port 1 as the input some power will couple to Port 4, and similarly for Port 2 input some will couple to Port 3. With Port 1 as the input, directivity is defined as $$D=10\log(P4/P3).$$

When the reverse power is coming into Port 1 of the coupler to be measured, it is doing so while the main power is applied to Port 2 and coupled to the Port 4 resistor. Mismatch at the resistor will be reflected to Port 3 and produce an error in the Port 3 reading of the power reflection.

The couplers 11 used in a preferred embodiment are loop type couplers in which the terminating resistors are provided by a tapered coaxial line. The taper is such that the coaxial impedance reduces along the length, so that the line impedance more closely corresponds to the resistance from that point to the end short circuit. In one embodiment, the resistor value used is the same as the coaxial line impedance of the coupled output. Thus, for the 50Ω resistors the line impedance is initially 50Ω, is 25Ω impedance at the resistor half length, and is a short current at the resistor end.

The use of a tapered coupler 11 reduces mismatch at the resistor and enhances directivity. The coupling loop comprises a broad (typically flat) line which is spaced off the ground plane of the coupler to be nominally 50Ω. Preferentially it is possible to tune the coupler to a match of 1.03:1 or better, when looking into the coaxial output of coupler, by adjusting the line width and by using small pieces of dielectric at the coupling loop.

This tuning of the coupler, plus physical rotation of the coupling loop while noting the directivity achieved, provides a coupler with directivity of 35 dB or better, with over 38 dB directivity being typically achieved. The VSWR Adaptive Tuner can be configured to work with either two (2) or three (3) directional couplers. The two coupler approach is most common and disposes both couplers 11 between the tube 14 and circulator 12 to measure forward and reverse power.

Consideration of Heating Effect on Reflected Power

The heating effect of power reflected back into a junction circulator 12 is dependent on the phase of the reflected power. In particular, the insertion loss between Ports 1 and 3 of a 3-Port circulator 12 (referring back to FIG. 1), when Port 2 is terminated in a short circuit, varies about twice the single pass loss. See J. Helszajn, G. Riblet, and J. Mather, "Insertion Loss of a 3-Port Circulator with one Port Terminated in a Variable Short Circuit", *I.E.E.E. Transaction on Microwave Theory and Techniques*, November 1975 pp 926-927

That is, if a junction circulator 12 dissipates a certain amount of power, say "X"Watts, in transmitting from Port 1 to Port 2 with zero reflection, then with 100% reflection at Port 2 to Port 3, the total Watts dissipated will vary approximately between X Watts and 3X Watts, depending on the phasing of the forward and reflected power. This means that with a knowledge of the amount of forward power into the junction there will be a minimum power dissipation condition possible, and based on knowledge of the circulation power detuning effects, an immediate current adjustment can be made.

FIG. 5 is a table showing anticipated power/current relationships for approximately optimized VSWR. Final settings are based on adjustment of the measured VSWR.

As can be noted from FIG. 5, the upper limit of corrective coil current is limited by the reflected power back into the junction. Therefore, if the reflected power is measured, then with this knowledge in addition to the forward power level then the coil current value may be changed to within the applicable range for these values. This can enhance the speed of VSWR correction for rapid changes. For most applications the circulator junctions being corrected are in the upper UHF range (600 to 900 MHz) and are extremely large. In these circumstances the use of only two couplers at the circulator input to measure VSWR, provides a sufficiently rapid correction of band pass, because of the thermal time constant of the circulator to changes in power.

The tuning conditions for a circulator 12 in a given embodiment are set by customer requirements. If the maximum normal operating power is given as M, then this is taken as a design goal to be a condition at which the circulator performance is optimized without the need of tuning coil current being introduced by the electromagnet 13. This is taken to be a good fail safe condition. It means that performance will not be optimum at system turn on or with significant reflected power, but will be optimized at full power with minimum reflection which should be the majority of the time in the event of tuner failure.

The setting of a circulator can be derived from low power testing at a range of temperatures. This can be done by running hot water into the cooling system to simulate the heating effects of high power. From the values of insertion loss (the percentage of power dissipated in the ferrite) the amount of heat generated in the ferrite at the given power M can then be calculated. Thermal analysis of the ferrite, circulator, and cooling plus the intended temperature of cooling water to be used then provides the expected ferrite temperature at power level M.

At low power, hot water at the correct temperature can be used to simulate operation at power M. The circulator permanent magnet is adjusted so that zero bias current is used.

When the circulator returns to room temperature or whatever the normal cooling temperature is specified to be, the circulator will require a value of current to return to optimum performance. This value is taken as a current value, −A.

It should be noted that if high power equipment is available, then the circulator can have its permanent magnet field optimized at power M when no bias field is used.

The table in FIG. 5 is only intended to demonstrate how, based on the measurements of the Forward and Reverse powers into the circulator, the ranges where the optimum bias should be found are calculated.

For a power PF into the circulator and PR into the output, from aHelzgraph effective worst phasing equivalent to.

$$P_{TOT}\text{Max}=(PF-PR)+3PR=PF+2PR \quad \text{(Eq. 1)}$$

i.e. there is equivalent single pass of (PF−PR) and worst phasing of 3 PR.

$$P_{TOT}\text{Min}=PF \quad \text{(Eq. 2)}$$

The parameters of the tuning are the zero power bias of −A, and the full powers (M) bias of zero, i.e.:

$$I=AM-A \quad \text{(Eq. 3)}$$

Figure 6:
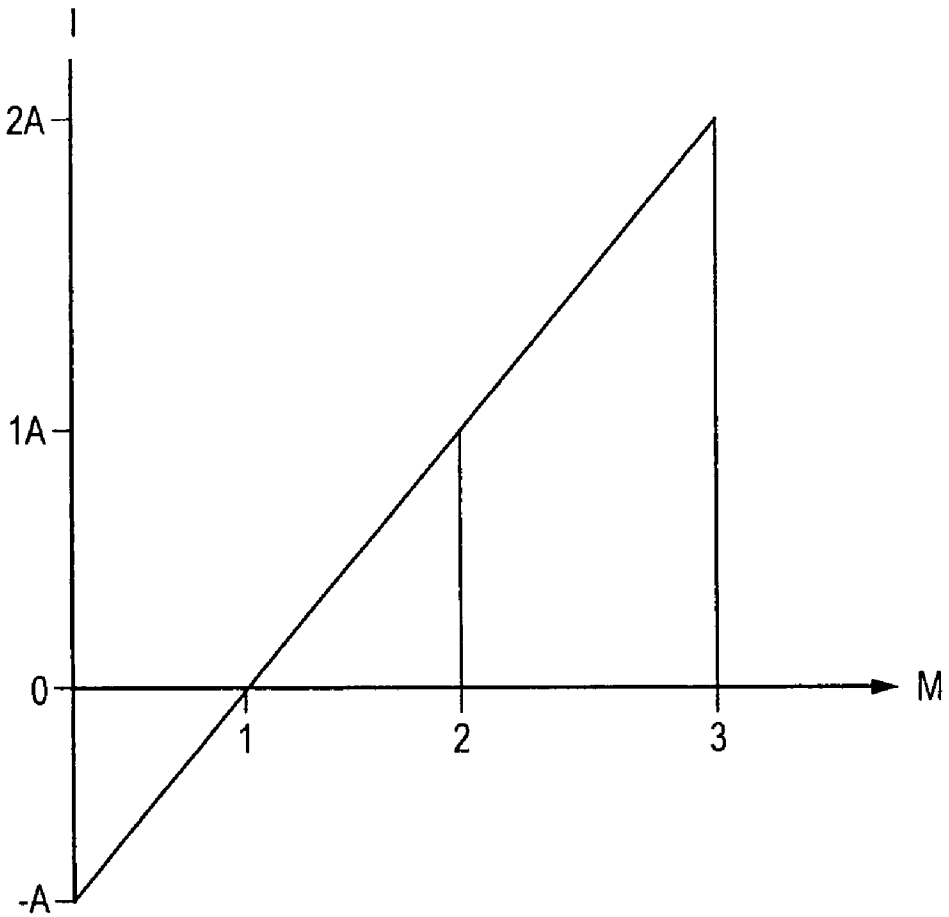
FIG. 6 is a plot of current versus power.

FIG. 6 is a generalized plot of this relationship.

A Microprocessor Based Implementation

Figure 7:
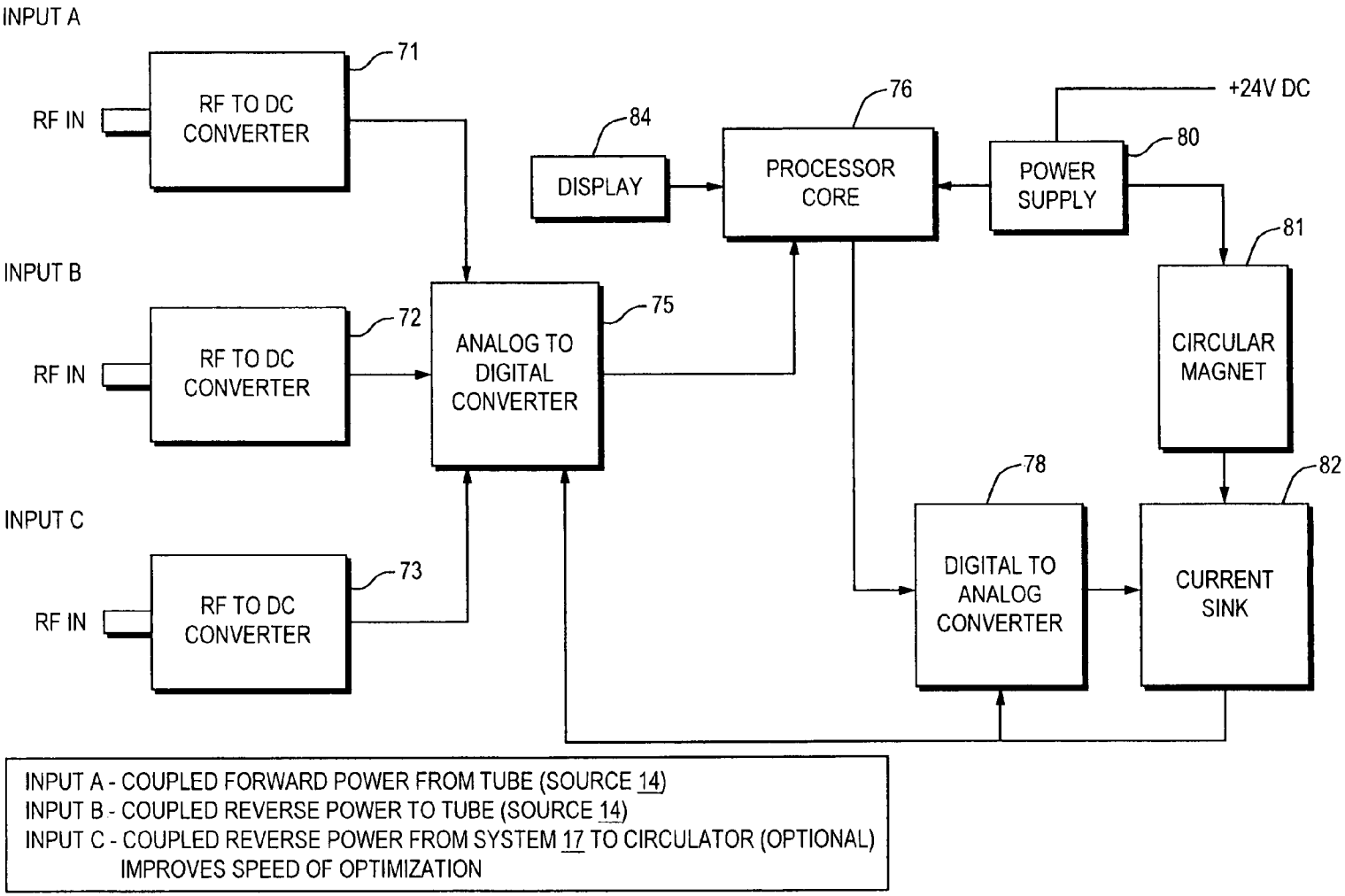
FIG. 7 is a high level schematic diagram of another embodiment of the controller.

Another embodiment of a compact VSWR adaptive tuner is shown in FIG. 7. This embodiment uses power conversion version integrated circuits to detect for forward and reverse power. RF power is first presented to an attenuator (not shown) to reduce the amplitude to a value not to impair the power converter integrated circuits (ICs). The unbalanced power signal is then converted to a balanced drive signal via a BALUN (not shown) to provide a differential drive signal to the power conversion ICs. The power conversion ICs converts the RF signals into a corresponding DC signal, with the output value proportional to the input power.

One of the RF channels takes the output from the power conversion ICs and applies it to a buffer amplifier (not shown). This buffer amplifier supplies a signal that can be viewed by an oscilloscope or other signal acquisition equipment. This channel also has a signal present detector to indicate the presence of RF power.

Two of the RF channels can have peak signal amplitude detectors for use in pulse applications. These peak detectors can have a software controlled sample and hold.

After being converted from a power, the DC signal is applied to the a bit analog to digital converter 25. The A/D converter 25 also measures the current being drawn by the circulator magnet 81. Digital data is read by the processor core 25 and converted to a magnet drive value.

The processor core 76 also sends digital data corresponding to the current needed by the circulator magnet to the D/A converter 78. The output of the D/A converter 18 is a 0 to 5 volt signal that represents a 0 to 5 amp current draw.

The current sink 82 takes the 0-5 VDC signal from the D/A converter 78, amplifies it, compares it to the actual current being delivered and generates an error signal that is applied to a power NPN darlington transistor (not shown). Current from the magnet windings is sent through a pair of relays (not shown), that control the direction of the current through the circulator magnet, then to the collector of the power darlington transistor. Current through the circuit is monitored by low resistance resistors in the emitter of the power NPN darlington transistor. The voltage developed across the emitter resistors is amplified and sent back as an error signal to keep the current drawn by the circulator constant.

The processor core 76 is a high performance microcontroller with onboard program storage and RAM. An Ethernet port is an available option. The processor communicates to the outside world via the Ethernet port or via an RS-422 serial port. Communication via the RS-422 port can be multi-drop with up to 15 units on a single full duplex cable. Status is displayed through a 2 line by 20 character VF display. The processor core has access to 128 KB of non volatile storage for use as a datalogger.

The processor core uses the measured forward and reverse levels at the circulator input, and the reverse power back into the circulator when measured, to determine the current level region required based on the analysis described above in connection with FIG. 5.

An iterative process is then used to step the current until no further improvement can be achieved. After optimization, degradation of VSWR by more than 1.03 causes a new procedure to begin.

The components are placed in a shielded enclosure similar to the embodiment of FIG. 1.

Specific components may be

| | |
|---|---|
| RF to DC Converter-Analog Devices | AD8362 |
| A to D Converter-Linear Tech. | LTC 1293 |
| Microprocessor-Rabbit Semiconductor | RCM 2100 |
| D to A Converter-Microchip | MCP4921 |

While this invention has been particularly shown and described with references to example embodiments thereof, it will be understood by those skilled in the art that various changes in form and details may be made therein without departing from the scope of the invention encompassed by the appended claims.

What is claimed is:

1. An integral unit for controlling a microwave source comprising:

a first loop coupler disposed between the source and a circulator to measure forward power;

a second loop coupler disposed between the source and circulator to measure reverse power;

both the first and second couplers having a tapered termination impedance.

2. An apparatus as in claim 1 wherein a directivity of the loop couplers is at least 35 dB.

* * * * *